US009420392B2

(12) United States Patent
Kuehne et al.

(10) Patent No.: US 9,420,392 B2
(45) Date of Patent: Aug. 16, 2016

(54) METHOD FOR OPERATING A VIRTUAL REALITY SYSTEM AND VIRTUAL REALITY SYSTEM

(71) Applicant: AUDI AG, Ingolstadt (DE)

(72) Inventors: Marcus Kuehne, Beilngries (DE); Thomas Zuchtriegel, Munich (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 14/729,406

(22) Filed: Jun. 3, 2015

(65) Prior Publication Data

US 2015/0382131 A1 Dec. 31, 2015

(30) Foreign Application Priority Data

Jun. 26, 2014 (DE) ..... 10 2014 009 298

(51) Int. Cl.
*H04S 5/02* (2006.01)
*H04S 7/00* (2006.01)

(52) U.S. Cl.
CPC ..... *H04S 7/304* (2013.01); *H04S 2400/11* (2013.01)

(58) Field of Classification Search
None
See application file for complete search history.

(56) References Cited

U.S. PATENT DOCUMENTS 6,614,912 B1 * 9/2003 Yamada ..... H04S 1/005 381/310
2004/0156512 A1 * 8/2004 Parker ..... H04R 5/033 381/74
2006/0029243 A1 2/2006 Gerrard et al.
2007/0053532 A1 * 3/2007 Elliott ..... H04R 3/12 381/302
2008/0144794 A1 6/2008 Gardner
2011/0096941 A1 * 4/2011 Marzetta ..... G06F 3/013 381/92
2011/0286614 A1 * 11/2011 Hess ..... H04S 7/303 381/302
2012/0008806 A1 * 1/2012 Hess ..... H04R 1/023 381/302
2015/0382130 A1 * 12/2015 Connor ..... H04S 7/304 381/303

FOREIGN PATENT DOCUMENTS

DE 10 2014 009 298.4 6/2014

OTHER PUBLICATIONS

German Office Action for German Priority Patent Application No. 10 2014 009 298.4, issued Mar. 27, 2015, 7 pages.
Durand R. Begault and Leonard J. Trejo, "3-D sound for virtual reality and multimedia," 2000, pp. 4-7, 39-40, 69-71, 165-190, http://ntrs.nasa.gov/search.jsp?R=20010044352.
Paul Grimm et al., Virtual and Augmented Reality (VR/AR), Berlin Heidelberg: Springer, 2013, pp. 7-8, 12-15, 43, 68-69, 84-85, 151-154, http://rd.springer.com/book/10.1007/978-3-28903-3.

* cited by examiner

*Primary Examiner* — Thang Tran
(74) *Attorney, Agent, or Firm* — Staas & Halsey LLP

(57) ABSTRACT

A virtual reality system is operated by, detecting a spatial position of a head of a first person who is wearing virtual reality glasses and headphones, displaying a virtual object within a virtual environment from a virtual direction of view by the virtual reality glasses. The virtual direction of view is specified depending on the detected spatial position of the head. An acoustic recording is reproduced by the headphones. A speech sound of a second person is detected a microphone device and converted into a speech signal. The speech signal is also reproduced by the headphones, the left and right loudspeakers of the headphones being operated depending on the detected spatial position of the head such that the speech signal is reproduced by the loudspeakers as if the speech sound were to pass to the first person without the headphones being worn.

20 Claims, 3 Drawing Sheets

METHOD FOR OPERATING A VIRTUAL REALITY SYSTEM AND VIRTUAL REALITY SYSTEM

CROSS REFERENCE TO RELATED APPLICATIONS

This application is based on and hereby claims priority to German Application No. 10 2014 009 298.4 filed on Jun. 26, 2014, the contents of which are hereby incorporated by reference.

BACKGROUND

The invention relates to a method for operating a virtual reality system and a virtual reality system.

A virtual reality system is a system by which a virtual reality can be displayed. The virtual reality system comprises in particular so-called virtual reality glasses, being a certain form of a so-called head-mounted display, i.e. a visual output device that can be worn on the head. It presents images on a display screen close to the eyes or projects them directly onto the retina. In this case a pair of virtual reality glasses additionally comprises sensors for motion detection of the head. This enables the display of the calculated graphics to be adapted to the movements of the wearer of the glasses. As a result of the physical proximity, the displayed image areas of the head-mounted display are effectively significantly larger than the free-standing display screens and in extreme cases even cover the entire field of view of the user. Because the display follows all head movements of the wearer as a result of the head mounting, the wearer has the sensation of moving directly in a landscape generated by a computer.

A virtual reality can thus be displayed by such virtual reality glasses, wherein the display of and at the same time the perception of reality in its physical characteristics in an interactive virtual environment generated by computer in real time are usually referred to as a virtual reality.

Such a virtual reality system can for example be used for the marketing of motor vehicles, in order to represent a motor vehicle virtually by the virtual reality glasses. In particular, in the case of such an application there is a challenge that the wearer of the virtual reality glasses is played very high quality sound by suitable headphones on the one hand and at the same time should be able to comprehend information from a salesperson and/or other associates and to follow their conversations.

The wearer of the virtual reality glasses can for example move around a virtual object, for example a motor vehicle, within a displayed virtual environment. A particular challenge in this connection is to play the spoken utterings of people in the surroundings of the wearer of the virtual reality glasses by said headphones so that the wearer of the virtual reality glasses is not confused.

SUMMARY

It is one possible object to provide a method for operating a virtual reality system and a virtual reality system that enables a wearer of virtual reality glasses to be provided especially with the spoken utterings of one or more people in an improved manner.

The inventors propose a method for operating a virtual reality system comprises the following:

Detecting a spatial position of a head of a first person wearing virtual reality glasses and headphones;

Displaying at least one virtual object within a virtual environment from a virtual direction of view by the virtual reality glasses, wherein the virtual direction of view is specified depending on the detected spatial position of the head;

Reproducing an acoustic recording by the headphones;

Detecting speech sound from at least one second person by a microphone device and converting the detected speech sound into a speech signal;

Reproducing the speech signal by the headphones, wherein a left loudspeaker and a right loudspeaker of the headphones are operated depending on the detected spatial position of the head such that the speech signal is reproduced by the loudspeakers as the speech sound would pass to the first person without the headphones being worn (ears, ear canal).

On the one hand the proposed method enables a wearer of virtual reality glasses to receive a particularly realistic display of a virtual object within a virtual environment, because he can change his viewing angle to the displayed virtual object in a simple manner by varying the spatial position of his head. Preferably, it is also possible in this case that the wearer of the virtual reality glasses can move within the displayed virtual environment. In other words, this means that he can vary his virtual position within the virtual environment, so that the respective perspective of the virtual object can be varied. In addition, an acoustic recording is reproduced by the headphones, so that for example very high quality sounding sound is played, whereby the virtual reality experience can be further improved or heightened.

It is important for the method that the speech signal is reproduced by the headphones so that a left and a right loudspeaker of the headphones are operated depending on the detected spatial position of the head of the wearer of the virtual reality glasses such that the speech signal is reproduced by the loudspeakers as the speech sound would pass to the wearer of the virtual reality glasses without the headphones being worn. Thus if the wearer of the virtual reality glasses were to change his virtual position within the virtual environment, then the acoustically detectable position of the second person would not change for the wearer of the virtual reality glasses.

In other words, the headphones are operated such that regardless of the virtual positioning within the virtual environment, the same directional localization can always be ensured by the reproduction of the speech signal, and indeed as if the user were hearing the second person without wearing headphones. Besides the second person, who can for example be a salesperson, there can for example also be a third person present. The speech sound from the third person can also be detected and converted into a corresponding speech signal by the microphone device. The speech signal of the third person is also reproduced by the headphones such that a left and a right loudspeaker of the headphones are operated depending on the detected spatial position of the head of the wearer of the virtual reality glasses such that the speech signal of the third person is also reproduced by the loudspeakers as if the speech sound were to pass to the wearer of the virtual reality glasses without the headphones being worn.

The wearer of the virtual reality glasses thus always has a substantially fixed directional localization in relation to the vocal utterings of people in the surroundings of the wearer of the virtual reality glasses, so that he maintains a type of acoustic orientation and anchoring to reality, even if the virtual environment is displayed in a particularly realistic manner.

An advantageous embodiment provides that a transition time difference between the left and the right loudspeakers of the headphones is adjusted while reproducing the speech signal depending on the detected spatial position of the head of the first person. This enables the speech signal to be reproduced by the loudspeakers particularly realistically as if the speech sound were to pass to the first person without the headphones being worn.

A further advantageous embodiment provides that while reproducing the speech sound a level difference between the left and the right loudspeakers of the headphones is adjusted depending on the detected spatial position of the head of the first person. This also allows the speech signal from the loudspeakers to be particularly realistically reproduced as if the speech sound were to pass to the first person without the headphones being worn.

In another advantageous embodiment it is provided that the speech sound is recorded by a binaural recording method, especially by a binaural dummy head recording. In the simplest case, two microphones are used that face laterally away from each other and are separated from each other by a spacing of about 17 cm to 22 cm, preferably of 17.5 cm. Said spacing and the placement approximately represent the position of the ear canals of an average human. An isolating body that absorbs or even reflects the sound, such as for example a football or a metal plate, is placed between the microphones in order to approximately simulate a head. By said type of recording of the sound, a particularly natural audio impression with a particularly accurate directional localization can be produced by the headphones. This is because binaural recordings, which replace the natural ear signals inhibited by headphone reproduction, represent the best possibility of realistically reproducing a spatial hearing impression.

Preferably, the microphone device comprises an artificial head fitted with a binaural recording device that is positioned between the first person and the second person, especially on a connecting line between the first and the second persons, wherein the speech sound is recorded by the binaural recording device. The artificial head is a head simulation, wherein the recording device for example comprises two capacitor studio microphones with omnidirectional characteristics inserted in an artificial ear canal of the artificial head. This arrangement simulates so-called head-related transmission functions, also known by the term head-related transfer functions.

In another advantageous embodiment, it is provided that the relative location and/or the position of the artificial head to the head of the first person, especially also to the head of the second person, is detected and taken into account during the reproduction of the speech signal. The corresponding location and position information are preferably used to control the reproduction of the speech signal such that a particularly realistic and spatial hearing impression is reproduced by the reproduction using the headphones, so that a particularly accurate directional localization is possible for the first person.

According to an alternative advantageous embodiment, it is provided that the microphone device comprises a microphone worn by the other person, by which the speech sound is recorded. Because the microphone device is worn by the other person, the speech sound of the other person is mainly recorded, wherein other ambient noise is recorded less strongly by the microphone device.

In another advantageous embodiment, it is provided that the relative location and/or position of the head of the second person to the head of the first person is recorded and taken into account during the reproduction of the speech signal. In other words, the relative positioning of the two people to each other and the respective orientation of the heads of the two people to each other are thus taken into account, so that the speech signal can be output such that a particularly good spatial hearing impression can be realistically achieved for the second person by playing back by the headphones.

According to another advantageous embodiment, it is provided that other ambient noise is recorded by the microphone device, wherein said ambient noise is filtered out and not reproduced by the headphones if said ambient noise is lower by a predefined volume level than the recorded speech sound of the second person. Therefore, in particular conversations from a certain distance can effectively be blocked and not transferred via the headphones, which is especially helpful in a semi-public situation in a sales room.

In another advantageous embodiment, it is provided that further ambient noise is recorded by the microphone device, wherein said ambient noise, with the exception of the speech sound of the second person, is attenuated by active noise compensation generated by the headphones. In other words, a type of antisound is thus produced, by which the remaining ambient noise apart from the speech sound of the second person is attenuated or eliminated.

The virtual reality system comprises

- virtual reality glasses that are designed to display at least one virtual object within a virtual environment;
- a detecting device that is designed to detect a spatial position of a head of a first person wearing the virtual reality glasses;
- a control device that is designed to determine a virtual direction of view depending on the detected spatial position of the head of the first person and to control the virtual reality glasses such that they display the virtual object within the virtual environment from the virtual direction of view;
- a microphone device that is designed to detect a speech sound of at least one second person and to convert it into a speech signal;
- headphones with a left and a right loudspeaker that are designed to reproduce an acoustic recording and the speech signal;
- wherein the control device is designed to control the headphones such that the left and the right loudspeakers of the headphones are operated depending on the detected spatial position of the head such that the speech signal is reproduced by the loudspeakers as if the speech sound were to pass to the first person without the headphones being worn.

The advantageous embodiments of the method are to be viewed here as advantageous embodiments of the virtual reality system, wherein the virtual reality system carries out the method.

Further advantages, features and details are revealed in the following description of preferred exemplary embodiments and using the figures. The features and combinations of features mentioned above in the description and the features and combinations of features mentioned below in the description of the figures and/or shown in the figures alone cannot only be used in the respectively specified combination but also in other combinations or on their own without departing from the scope.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
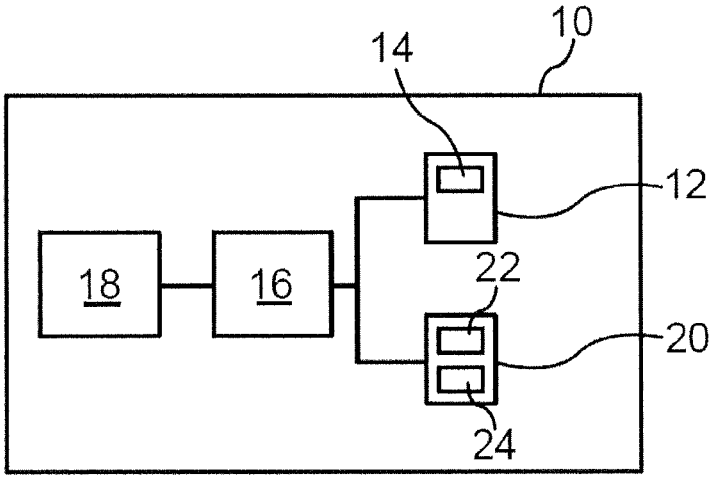
FIG. 1 shows a schematic illustration of a virtual reality system for the display of a virtual object within a virtual environment.

Reference will now be made in detail to the preferred embodiments of the present invention, examples of which are illustrated in the accompanying drawings, wherein like reference numerals refer to like elements throughout.

In the figures, identical or functionally equivalent elements are provided with the same reference characters.

A virtual reality system 10 for displaying a virtual environment is shown in a schematic illustration in FIG. 1. The virtual reality system 10 comprises virtual reality glasses that are designed to display at least one virtual object within a virtual environment. The virtual reality glasses 12 comprise in this case a detecting device 14 that is designed to detect a spatial position of a head of a person wearing the virtual reality glasses 12.

Moreover, the virtual reality system 10 comprises a control device 16 that is designed to determine a virtual direction of view depending on the detected spatial position of the head of the wearer of the virtual reality glasses 12 and to control the virtual reality glasses 12 such that they display the currently displayed virtual object within the virtual environment from the virtual direction of view.

Moreover, the virtual reality system 10 comprises a microphone device 18 that is designed to detect speech sound from at least one second person and to convert it into a speech signal. Finally, the virtual reality system 10 comprises headphones 20 with a left and a right loudspeaker 22, 24 designed to reproduce an acoustic recording and the speech signal. In this case the control device 16 is designed to control the headphones 20 such that the left and the right loudspeakers 22, 24 of the headphones 20 are operated depending on the detected spatial position of the head of the wearer of the virtual reality glasses 12 such that the speech signal is reproduced by the loudspeakers 22, 24 as if the speech sound of the other person were to pass to the wearer of the virtual reality glasses 12 without the headphones 20 being worn.

Figure 2:
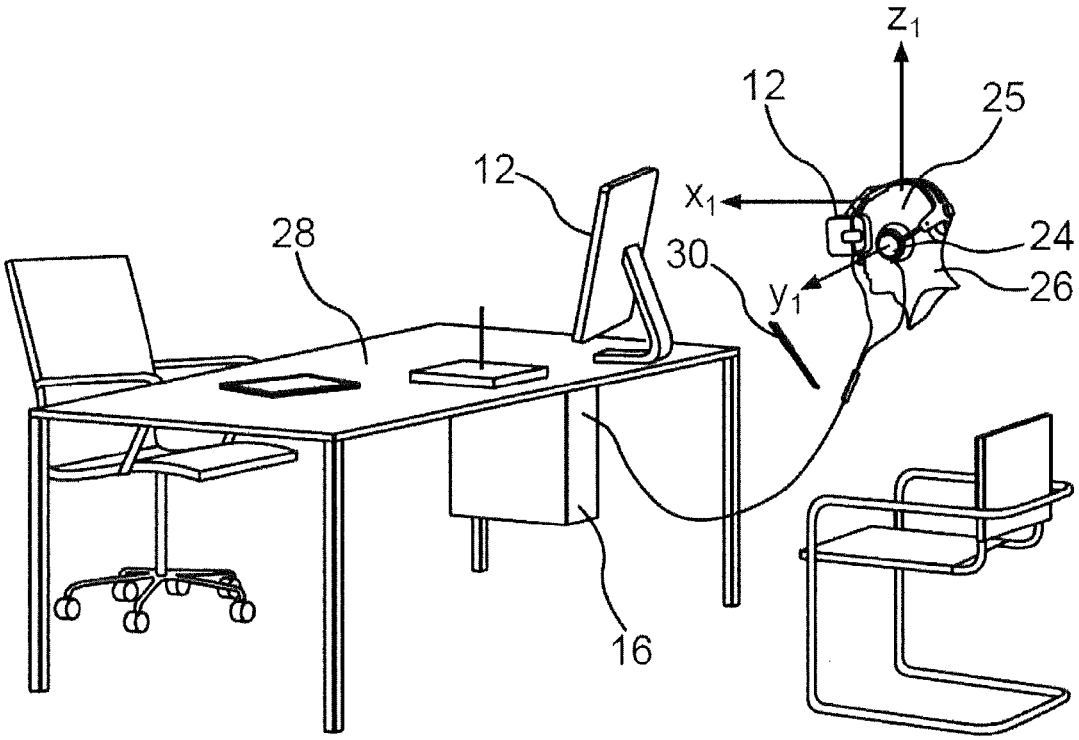
FIG. 2 shows a perspective view of a partially illustrated sales room, wherein a person is wearing virtual reality glasses of the virtual reality system.

An unspecified sales room in a car dealership is shown in FIG. 2. In the present case a first person 26 is wearing the virtual reality glasses 12 of the virtual reality system 10. The virtual reality glasses 12 are coupled in the present case to the control device 16 disposed under a table 28, wherein the control device can be a conventional PC for example. Furthermore, the virtual reality system 10 comprises a remote controller 30, by which the user 26 can control the display of the virtual reality glasses 12. A coordinate system that is fixed relative to the head of the first person 26 is denoted by the axes $x_1$, $y_1$ and $z_1$.

Figure 3:
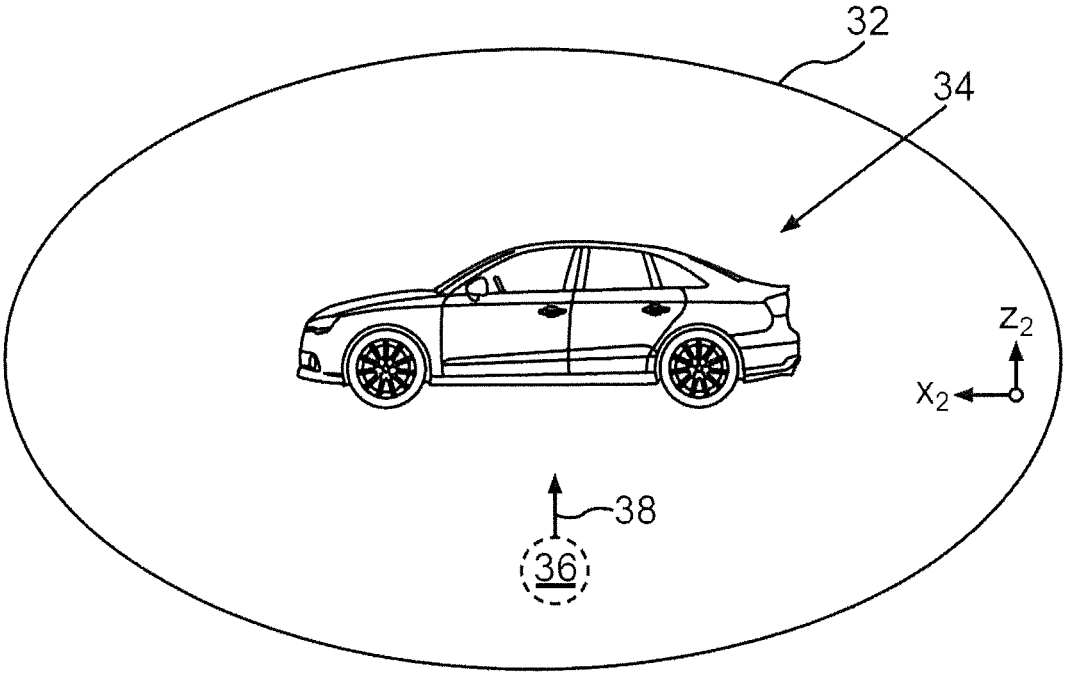
FIG. 3 shows an illustration of a virtual environment in which a virtual object in the form of a motor vehicle is displayed in a side view.

In FIG. 3 a virtual environment 32 is shown, wherein a virtual object in the form of a motor vehicle 34 is displayed within said virtual environment 32. The current virtual position of the first person 26 within the virtual environment 32 is characterized with the dashed circle 36. The current virtual direction of view, starting from the virtual position 36, is characterized by the arrow 38. The virtual direction of view 38 corresponds here to the current spatial position, i.e. the orientation, of the first person 26 that is wearing the virtual reality glasses 12. If the wearer swivels his head for example to the left, then he is no longer looking, as shown here, at the motor vehicle 34, but rather at a region further to the left within the virtual environment 32. The same also applies to an upward and downward pivoting movement of the head of the person 26. Furthermore, the person 26 can move within the virtual environment 32, for example by suitable operation of the remote controller 30, i.e. can for example virtually move around the vehicle 34. The coordinate system within the virtual environment 32 is denoted by the axes $x_2$, $y_2$ and $z_2$.

In addition to a purely visual illustration of the virtual environment 32, a recording backing the virtual illustration is played by the headphones 20. For example, the recording can be purely music or even suitable operating sound of the virtual motor vehicle 34, such as for example exhaust noise, sound from the stereo system of the motor vehicle 34 and similar. In this case, said virtual noises can for example also be changed depending on the virtual position of the person 26 within the virtual environment 32, so that a type of virtual spatial hearing impression can be enabled within the displayed virtual environment 32 by playing back by the headphones 20.

Figure 4:
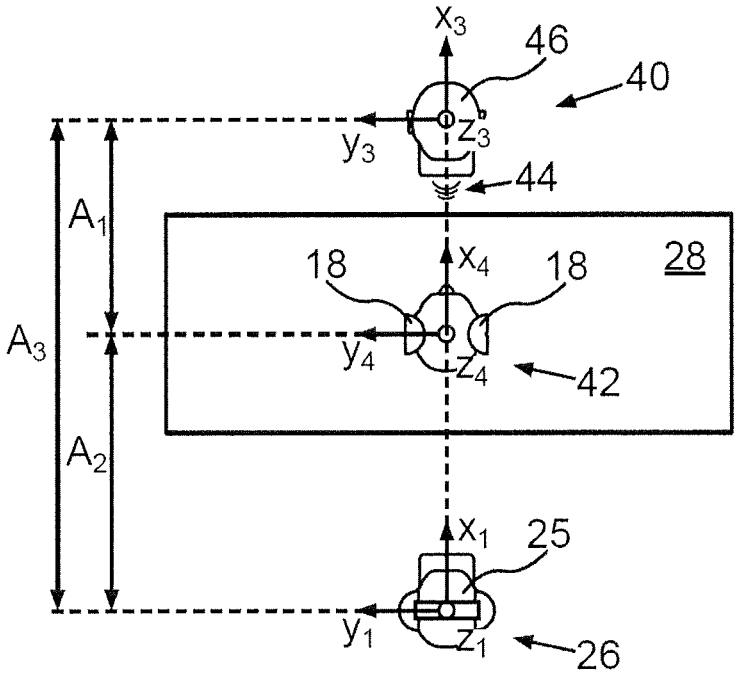
FIG. 4 shows a schematic top view of a possible embodiment of the sales room illustrated in FIG. 2, wherein besides the person wearing the virtual reality glasses another person and an artificial head disposed between them are illustrated.

In FIG. 4 a possible arrangement of the first person 26 relative to a second person 40, for example a salesperson in a car dealership, is shown in a schematic top view. An artificial head 42 is disposed between the first person 26 and the second person 40 on the table 28 of the sales room. In the present case the microphone device 18 is formed by respective unspecified microphones disposed on the outside of the artificial head 42. Speech sound 44 emitted by the second person 40 is detected by the microphone device 18. In the present case the speech sound 44 is thus detected by a binaural recording method, more accurately by a binaural dummy head recording. The relative location and/or position of the artificial head 42 to the head 25 of the first person 26 and also to the head 46 of the second person 40 is detected in this case and is taken into account during the reproduction of the speech signal by the headphones 20.

The speech signal is reproduced here by the headphones 20, wherein the left and the right loudspeakers 22, 24 of the headphones 20 are operated depending on the detected spatial position of the head 25 of the first person 26 and the additional detected positions and location information of the head 25 relative to the artificial head 42 and of the head 46 of the second person 40 such that the speech signal is reproduced by the loudspeakers 22, 24 as if the speech sound were to pass to the first person without the headphones 20 being worn, more accurately to his ears or into his ear canals. For example, when reproducing the speech signal a transition time difference and/or level difference between the left and right loudspeakers 22, 24 of the headphones 20 is adjusted depending on the spatial location and position information.

A coordinate system that is fixed relative to the head of the second person 40 is denoted by the axes $x_3$, $y_3$ and $z_3$. A coordinate system that is fixed relative to the artificial head 42 is denoted by the axes $x_4$, $y_4$ and $z_4$. The respective relative locations relative to the fixed coordinate systems of the head 46 of the second person, of the artificial head 42 and of the head 25 of the first person 26 can thus be detected and analyzed in relation to their locations and positioning relative to each other. Moreover, the volume setting with which the speech signal converted from the detected speech sound 44 by the headphones 20 is fed through the headphones 20 is adjusted taking into account the respective spacings $A_1$, $A_2$ and $A_3$ between the respective heads 25, 42, 46.

Thus if the first person 26 is moving around within the virtual environment 32 by the displayed contents of the virtual reality glasses 12, the detected speech sound 44 is always played through the headphones 20 by the converted speech signal such that the perceived position of the second person 40 relative to the first person 26 does not change. In other words, the directional localization for the first person 26, who is wearing the virtual reality glasses 12, always remains constant relative to the second person 40, at least while the second person 40 is not moving.

Further ambient noise can for example also be detected by the microphone device 18, wherein said ambient noise is filtered out and is not reproduced by the headphones 20 if said ambient noise is lower by a predefined volume level than the detected speech sound of the second person 40. This enables speech from a defined distance to be effectively blocked and not transferred to the first person 26 by the headphones 20, which is especially useful in the case of a semi-public situation in a car dealership.

Alternatively or additionally, it is also possible for the headphones 20 to be so-called active noise cancelling headphones. Either the headphones 20 themselves comprise suitable microphones for detecting the ambient sound or the sound information acquired by the microphone device 18, with the exception of the speech sound 44 of the second person 40, is attenuated by active noise compensation produced by the headphones 20, i.e. by antisound. This also allows it to be ensured that above all only the speech sound 44 passes to the ears of the first person 26.

Figure 5:
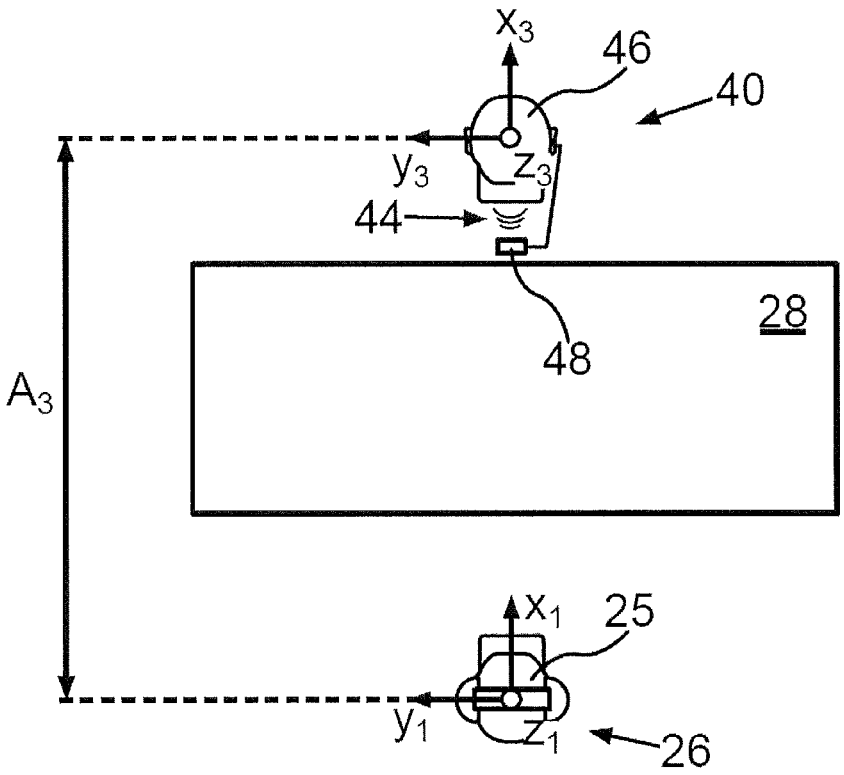
FIG. 5 shows a schematic top view of an alternative embodiment of the sales room, wherein again the wearer of the virtual reality glasses and here only the person opposite are illustrated, wherein said person opposite is wearing microphone.

An alternative arrangement between the first and the second persons is illustrated in FIG. 5. In the present case the artificial head 42 is no longer located between the first and the second persons 26, 40. Instead of this the second person 40 is wearing a microphone 48 belonging to the microphone device 18 immediately in front of his mouth, by which the speech sound 44 is detected. This has the advantage that ambient noise is hardly detected or is detected significantly less strongly than with the arrangement shown in FIG. 4. Here too the relative location and/or position of the head 46 of the second person 40 to the head 25 the first person 26 is detected and is taken into account during the reproduction of the converted speech signal. The speech signal is in turn reproduced by the headphones 20, wherein the left and right loudspeakers 22, 24 of the headphones 20 are operated depending on the detected location and position information such that the speech signal is reproduced by the loudspeakers 22, 24 as if the speech sound 44 were to pass to the first person 26 without the headphones 20 being worn. Here for example the transition time difference and/or even the level difference between the left and the right loudspeakers 22, 24 can be suitably adjusted in order to enable a most realistic reproduction of the detected speech sound 44 and an associated particularly accurate and realistic directional localization of the speech sound 44 and hence of the second person 40. In this connection it is possible to carry out active noise compensation in a similar manner in order to attenuate or block further ambient noise as far as possible. Or just as good, detected ambient noise can also be filtered out and not reproduced by the headphones 20, if it were to be lower by a predefined volume level than the detected speech sound 44 of the second person 40. The latter should be particularly simple to design because the microphone 48 is worn immediately in front of the mouth of the second person 40, so that the speech sound 44 emitted by the second person 40 should arrive significantly louder at the microphone 48 than the rest of the ambient noise.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV,* 69 USPQ2d 1865 (Fed. Cir. 2004).

The invention claimed is:

1. A method for operating a virtual reality system, the method comprising:

detecting a spatial position of a head of a first person who is wearing virtual reality glasses and headphones to produce a detected spatial position;

displaying a virtual object within a virtual environment from a virtual direction of view using the virtual reality glasses, wherein the virtual direction of view is specified depending on the detected spatial position of the head of the first person;

reproducing an acoustic recording using the headphones;

detecting speech sound from a second person using a microphone device to produce a detected speech sound;

converting the detected speech sound into a speech signal; and reproducing the speech signal using the headphones, wherein a left loudspeaker and a right loudspeaker of the headphones are operated depending on the detected spatial position of the head of the first person such that the speech signal is reproduced by the left loudspeaker and the right loudspeaker as if the speech sound from the second person were to pass to the first person without the headphones being worn.

2. The method according to claim 1, wherein reproducing the speech signal further comprises:

adjusting a transition time difference between the left loudspeaker and the right loudspeaker of the headphones depending on the detected spatial position of the head of the first person.

3. The method according to claim 1, wherein reproducing the speech signal further comprises:

adjusting a level difference between the left loudspeaker and the right loudspeaker of the headphones depending on the detected spatial position of the head of the first person.

4. The method according to claim 1, wherein detecting the speech sound comprises using a binaural recording method.

5. The method according to claim 4, wherein the binaural recording method includes using, a binaural dummy head recording.

6. The method according to claim 4, wherein the microphone device comprises an artificial head fitted with a binaural recording device, the artificial head is positioned between the first person and the second person on a connecting line between the first person and the second person, and detecting the speech sound comprises using the binaural recording device.

7. The method according to claim 4, wherein the microphone device comprises an artificial head fitted with a binaural recording device, the artificial head is positioned between the first person and the second person, detecting the speech sound comprises using the binaural recording device, and reproducing the speech signal further comprises:

recording a location and/or position of the artificial head relative to the head of the first person and to the head of the second person;

providing directional localization for the first person during the reproducing of the speech signal, using the location and/or position of the artificial head relative to the head of the first person and to the head of the second person.

8. The method according to claim 1, wherein the microphone device comprises a microphone worn by the second person, and detecting the speech sound comprises detecting the speech sound from the second person using the microphone worn by the second person.

9. The method according to claim 8, wherein reproducing the speech signal further comprises:

detecting a location and/or position of the head of the second person relative to the head of the first person; and reproducing the speech signal using the location and/or position of the head of the second person relative to the head of the first person.

10. The method according to claim 1, further comprising:

detecting ambient noise using the microphone device; and filtering the ambient noise such that the ambient noise is not reproduced by the headphones if the ambient noise is lower by a predefined volume level than the detected speech sound of the second person.

11. The method according to claim 1, further comprising:

detecting ambient noise using the microphone device; and attenuating the ambient noise while not attenuating, the detected speech sound of the second person, using active noise compensation produced by the headphones.

12. A virtual reality system, comprising:

virtual reality glasses to display a virtual object within a virtual environment;

a detecting device to detect a spatial position of a head of a first person wearing the virtual reality glasses to produce a detected spatial position;

a control device to determine a virtual direction of view depending on the detected spatial position of the head of the first person and to control the virtual reality glasses to display the virtual object within the virtual environment from the virtual direction of view;

a microphone device to detect speech sound from a second person to produce a detected speech sound, and to convert the detected speech sound into a speech signal;

headphones with a left loudspeaker and a right loudspeaker, to reproduce an acoustic recording and the speech signal;

wherein the control device controls the headphones such that the left loudspeaker and the right loudspeaker of the headphones are operated depending on the detected spatial position of the head of the first person such that the speech signal is reproduced by the left loudspeaker and the right loudspeaker as if the speech sound from the second person were to pass to the first person without the headphones being worn.

13. A method for operating a virtual reality system, the method comprising:

displaying a virtual object within a virtual environment for viewing from a first observation position within the virtual environment, the virtual object being displayed to a first person wearing virtual reality glasses using the virtual reality glasses;

virtually moving the first person in the virtual environment, from the first observation position to a second observation position within the virtual environment;

after virtually moving, displaying the virtual object within the virtual environment for viewing from the second observation position, the virtual object being displayed to the first person using the virtual reality glasses;

detecting speech sound from a second person using a microphone device and converting the speech sound from the second person into a speech signal; and reproducing the speech signal using the headphones, the speech signal being reproduced based on an actual position of the first person with respect to an actual position of the second person, such that when the first person moves in the virtual environment, the speech signal is altered only to the extent that the actual position of the first person with respect to the actual position of the second person also changes.

14. The method according to claim 13, further comprising:

while the first person views the virtual object within the virtual environment using the virtual reality glasses, reproducing an acoustic recording which does not include the speech signal of the second person, the acoustic recording being a virtual noise corresponding to a virtual sound producer within the virtual environment; and when the first person moves in the virtual environment, changing the virtual noise according to virtual movement of the first person from the first observation position to the second observation position.

15. The method according to claim 13, further comprising:

detecting a spatial position of a head of the first person, and reproducing the speech signal using the headphones further comprises adjusting at least one of a delay time and a level difference between a left loudspeaker and a right loudspeaker of the headphones, based on the spatial position of the head of the first person.

16. The method according to claim 15, further comprising:

detecting a spatial position of a head of the second person, and reproducing the speech signal using the headphones further comprises adjusting at least one of the delay time and the level difference between the left loudspeaker and the right loudspeaker, based on the spatial position of the head of the second person.

17. The method according to claim 13, further comprising:

detecting a distance from the first person to the second person, and reproducing the speech signal using the headphones further comprises adjusting a volume setting of at least one of a left loudspeaker and a right loudspeaker of the headphones using the distance from the first person to the second person.

18. The method according to claim 15, further comprising:

while the first person views the virtual object within the virtual environment using the virtual reality glasses, detecting speech sound from a third person and converting the speech sound from the third person into a speech signal; and reproducing the speech signal corresponding to the third person using the headphones by adjusting at least one of the delay time and the level difference between the left loudspeaker and the right loudspeaker, based on the spatial position of the head of the first person.

19. The method according to claim 13, further comprising: displaying, on a separate display viewable by the second person, the virtual environment and the virtual object being displayed to the first person.

20. The method according to claim 13, wherein the acoustic recording corresponds to the virtual object being displayed to the first person within the virtual environment, or to another virtual object within the virtual environment which is viewable by the first person.

* * * * *